US009499989B2

(12) United States Patent
Iannelli

(10) Patent No.: US 9,499,989 B2
(45) Date of Patent: Nov. 22, 2016

(54) LOCKING ADJUSTABLE GUTTER HANGER

(71) Applicant: Anthony M. Iannelli, Amelia, OH (US)

(72) Inventor: Anthony M. Iannelli, Amelia, OH (US)

( * ) Notice: Subject to any disclaimer, the term of this patent is extended or adjusted under 35 U.S.C. 154(b) by 0 days.

(21) Appl. No.: 14/679,380

(22) Filed: Apr. 6, 2015

(65) Prior Publication Data

US 2015/0284961 A1 Oct. 8, 2015

Related U.S. Application Data

(60) Provisional application No. 61/976,160, filed on Apr. 7, 2014.

(51) Int. Cl.
*E04D 13/064* (2006.01)
*E04D 13/072* (2006.01)

(52) U.S. Cl.
CPC ..... *E04D 13/0725* (2013.01)

(58) Field of Classification Search
CPC ..... E04D 13/072
See application file for complete search history.

(56) References Cited

U.S. PATENT DOCUMENTS 3,150,851 A * 9/1964 Ritchie ..... E04D 13/0725 248/300
3,416,760 A * 12/1968 Sauder ..... E04D 13/0725 248/48.2
3,426,987 A * 2/1969 Leslie ..... E04D 13/0725 248/48.2
3,752,428 A * 8/1973 Trostle ..... E04D 13/0725 248/48.2
4,579,303 A * 4/1986 Midlik ..... E04D 13/0722 248/222.41
4,610,412 A * 9/1986 Holden ..... E04D 13/0727 248/297.31
6,623,052 B2 * 9/2003 Hansen ..... E05B 1/0092 292/336.3
6,681,527 B2 1/2004 Baker
6,854,692 B1 2/2005 Winkel
7,624,541 B2 * 12/2009 Gentry ..... E04D 13/076 248/48.1

FOREIGN PATENT DOCUMENTS

WO WO 2005/007992 A2 1/2005

* cited by examiner

*Primary Examiner* — Amy J. Sterling
(74) *Attorney, Agent, or Firm* — Frost Brown Todd LLC

(57) ABSTRACT

An adjustable gutter hanger comprises: a gutter attachment piece, a building attachment piece, and a coupler. The gutter attachment piece comprises a gutter attachment portion adapted to contact the front of a gutter and a first flat portion, which has a first face interlocking mechanism, extending from the gutter attachment portion. The building attachment piece comprises a mounting section adapted to contact the rear of the gutter and a second flat portion, which has a second face interlocking mechanism, extending from the mounting section. At least one of the first flat portion or the second flat portion comprises at least one opening for receiving the coupler. The coupler is adapted to pass through the at least one opening to secure the first and second flat portions together. The first and second face interlocking mechanisms each comprise at least one interlocking portion that engage each other to prevent slipping.

10 Claims, 8 Drawing Sheets

LOCKING ADJUSTABLE GUTTER HANGER

CROSS REFERENCE TO RELATED APPLICATIONS

The present application hereby claims the benefit of the provisional patent application of the same title, Ser. No. 61/976,160, filed on Apr. 7, 2014, the disclosure of which is herein incorporated by reference in its entirety.

BACKGROUND

Gutter hangers are used to install a gutter to a building below the edges of a roof. The gutter hanger provides support for the gutter so it does not tip down over time or under a heavy load such as water during a heavy rainfall or ice in the winter. An adjustable gutter hanger assembly will allow a single type of gutter hanger to be used with gutters of different widths. However, it is desirable to have an adjustable gutter hanger that does not slip.

BRIEF SUMMARY

An adjustable gutter hanger comprises: a gutter attachment piece, a building attachment piece, and a coupler. The gutter attachment piece comprises a gutter attachment portion adapted to contact the front of a gutter and a first flat portion extending from the gutter attachment portion. The first flat portion has a first face interlocking mechanism. The building attachment piece comprises a mounting section adapted to contact the rear of the gutter and a second flat portion extending from the mounting section. The second flat portion has a second face interlocking mechanism. At least one of the first flat portion or the second flat portion comprises at least one opening for receiving the coupler. The coupler is adapted to pass through the at least one opening to secure the first and second flat portions together. The first and second face interlocking mechanisms each comprise at least one interlocking portion that engage each other to prevent slipping, especially slipping in the longitudinal direction.

A method for supporting a gutter on a building comprises the steps of: A) attaching a gutter attachment piece to the front of the gutter, B) contacting a building attachment piece to the rear of the gutter, C) interlocking the first and second face interlocking mechanisms, D) securing the gutter attachment piece and building attachment piece together with the coupler, and E) attaching the building attachment piece to the building. These steps may be carried out in most any order.

These and other objects and advantages shall be made apparent from the accompanying drawings and the description thereof.

BRIEF DESCRIPTION OF THE FIGURES

The accompanying drawings, which are incorporated in and constitute a part of this specification, illustrate embodiments, and together with the general description given above, and the detailed description of the embodiments given below, serve to explain the principles of the present disclosure.

DETAILED DESCRIPTION

Figure 1:
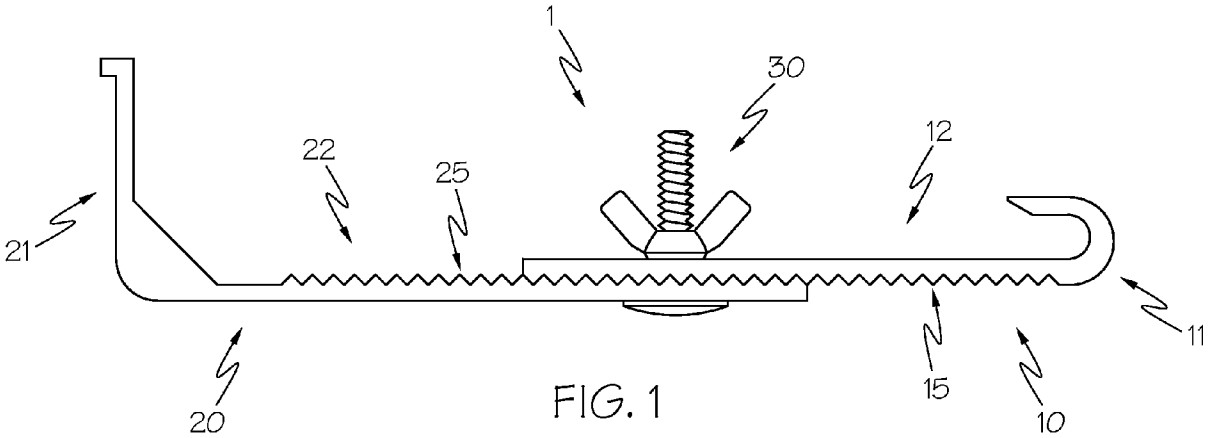
FIG. 1 depicts a side view of an embodiment of an adjustable gutter hanger.
Figure 2:
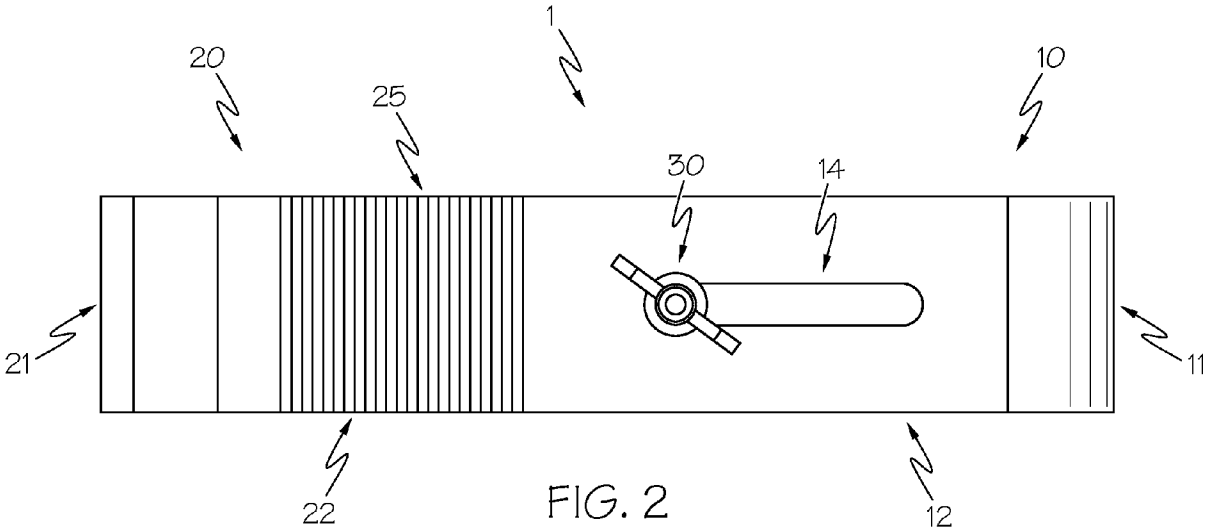
FIG. 2 depicts a top view of an embodiment of an adjustable gutter hanger.

As shown in FIGS. 1-2, an embodiment of an adjustable gutter hanger (1) comprises: a gutter attachment piece (10), a building attachment piece (20), and a coupler (30). The gutter attachment piece (10) comprises a gutter attachment portion (11) adapted to contact the front of a gutter and a first flat portion (12) extending from the gutter attachment portion (11). The first flat portion (12) has a first opening (14) for receiving the coupler (30), and a first face interlocking mechanism (15). The building attachment piece (20) comprises a mounting section (21) adapted to contact the rear of the gutter and a second flat portion (22) extending from the mounting section (21). The second flat portion (22) has a second opening (24) for receiving the coupler (30), and a second face interlocking mechanism (25). The coupler (30) is adapted to pass through the first and second openings (14, 24) to secure the first and second flat portions (12, 22) together. The first and second face interlocking mechanisms (15, 25) comprise at least one interlocking portion that engage each other to prevent slipping, especially slipping in the longitudinal direction.

Figure 4:
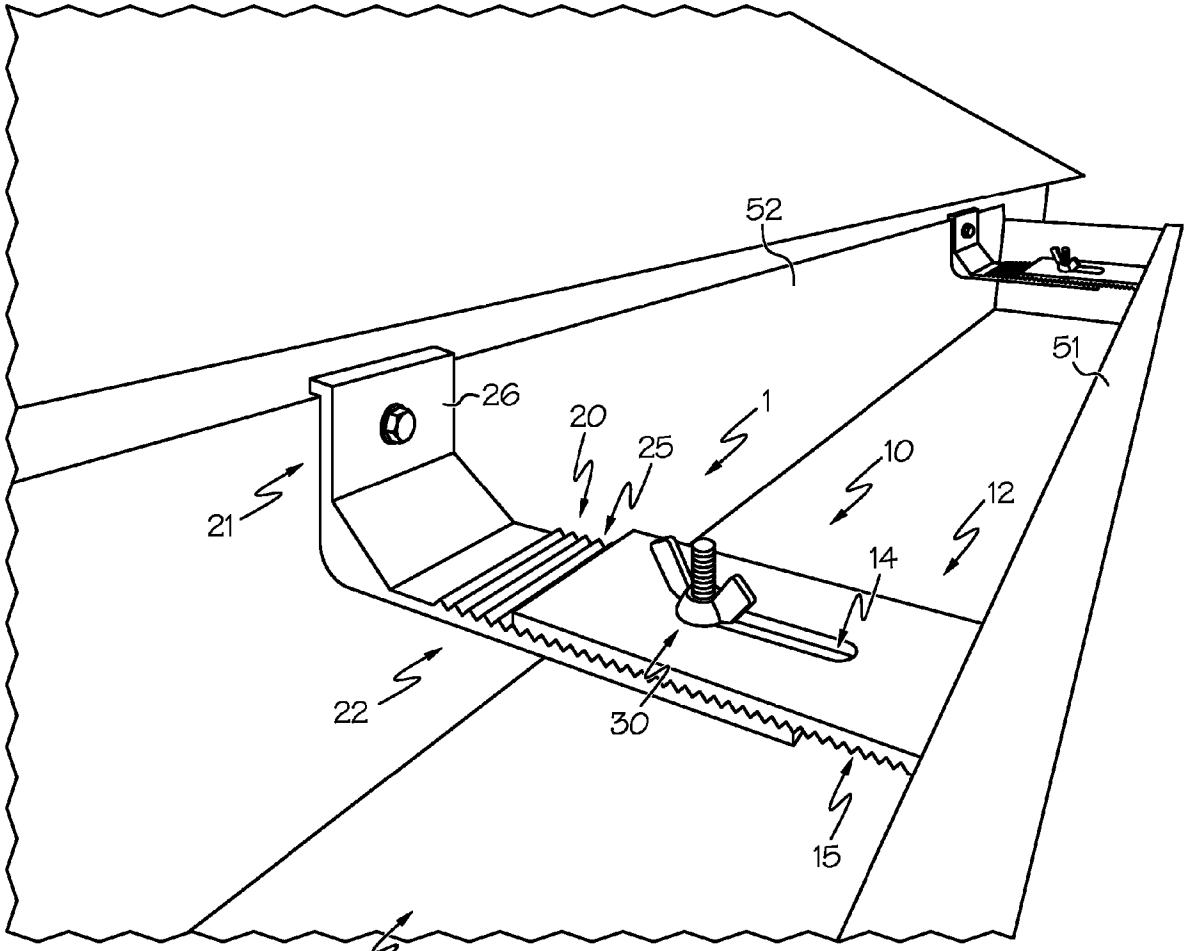
FIG. 4 depicts a perspective view of an embodiment of an adjustable gutter hanger installed in a gutter.

FIG. 4 shows an embodiment of an adjustable gutter hanger (1) installed in a gutter (50). The gutter attachment portion (11) fits under the front lip of the gutter (51). The mounting section (21) is in contact with the rear of the gutter (52), where a fastener (26) passes through the rear of the gutter (52) to secure the gutter to the building it is being mounted on.

Figure 5A:
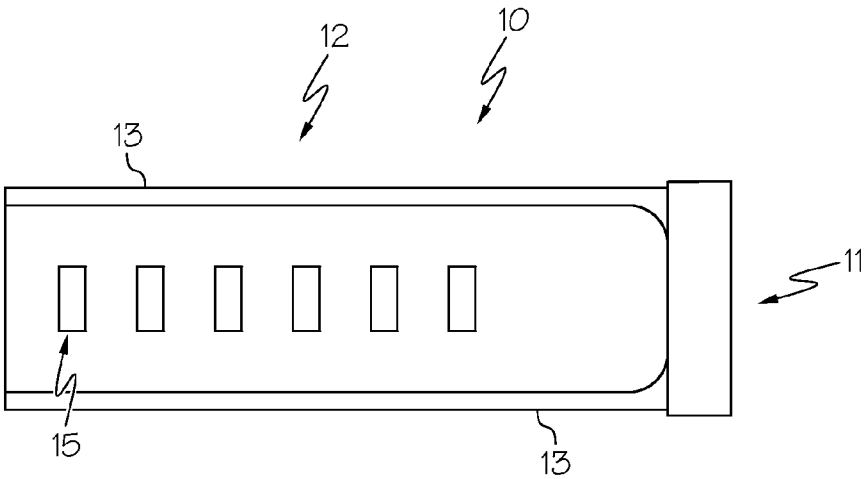
FIG. 5A depicts a top view of an embodiment of a gutter attachment piece of an adjustable gutter hanger.
Figure 5B:
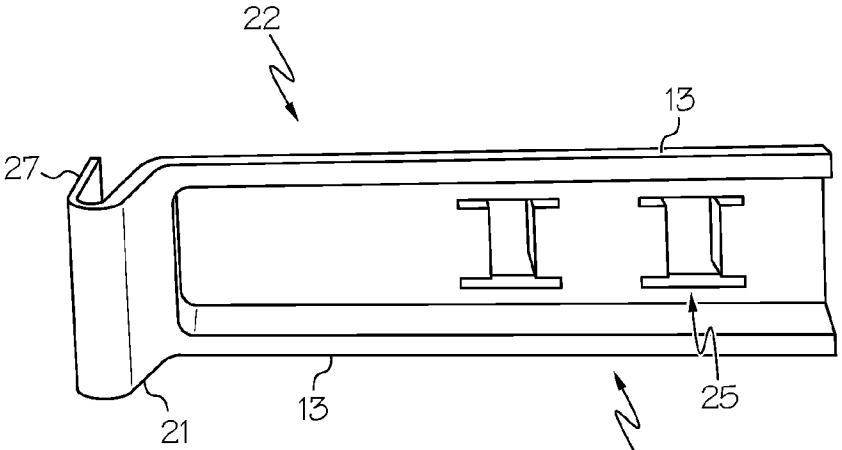
FIG. 5B depicts a top perspective view of an embodiment of a building attachment piece of an adjustable gutter hanger.
Figure 6A:
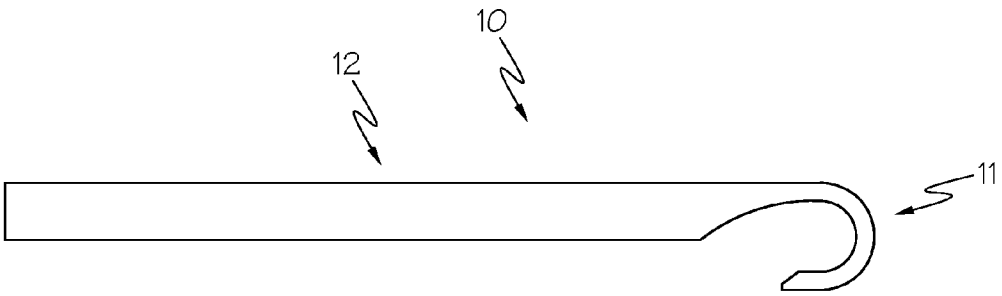
FIG. 6A depicts a side view of the gutter attachment piece of FIG. 5A.
Figure 6B:
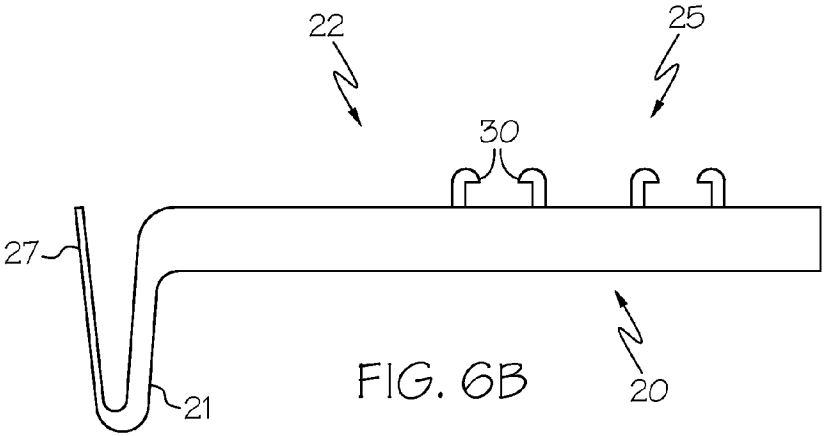
FIG. 6B depicts a side view of the building attachment piece of FIG. 6A.

As shown in FIGS. 5 and 6, an embodiment of an adjustable gutter hanger (1) comprises: a gutter attachment piece (10), a building attachment piece (20), and a coupler (30). The gutter attachment piece (10) comprises a gutter attachment portion (11) adapted to contact the front of a gutter and a first flat portion (12) extending from the gutter attachment portion (11). The first flat portion (12) has a first face interlocking mechanism (15), which also receives the coupler (30). The building attachment piece (20) comprises a mounting section (21) adapted to contact the rear of the gutter and a second flat portion (22) extending from the mounting section (21). The second flat portion (22) has a second face interlocking mechanism (25), which also acts as the coupler (30). The coupler (30) is adapted to pass through the opening in the first face interlocking mechanism (15) to secure the first and second flat portions (12, 22) together. The first and second face interlocking mechanisms (15, 25)

comprise at least one interlocking portion that engage each other to prevent slipping, especially slipping in the longitudinal direction.

The adjustable gutter hanger may be made from plastic or metal, such as aluminum. It may be formed by molding, extruding, stamping, or combinations thereof The flat portions may additionally comprise ribs to increase rigidity, such as ribs (13) on the edges of the flat portions as shown in FIG. 5.

Figure 3:
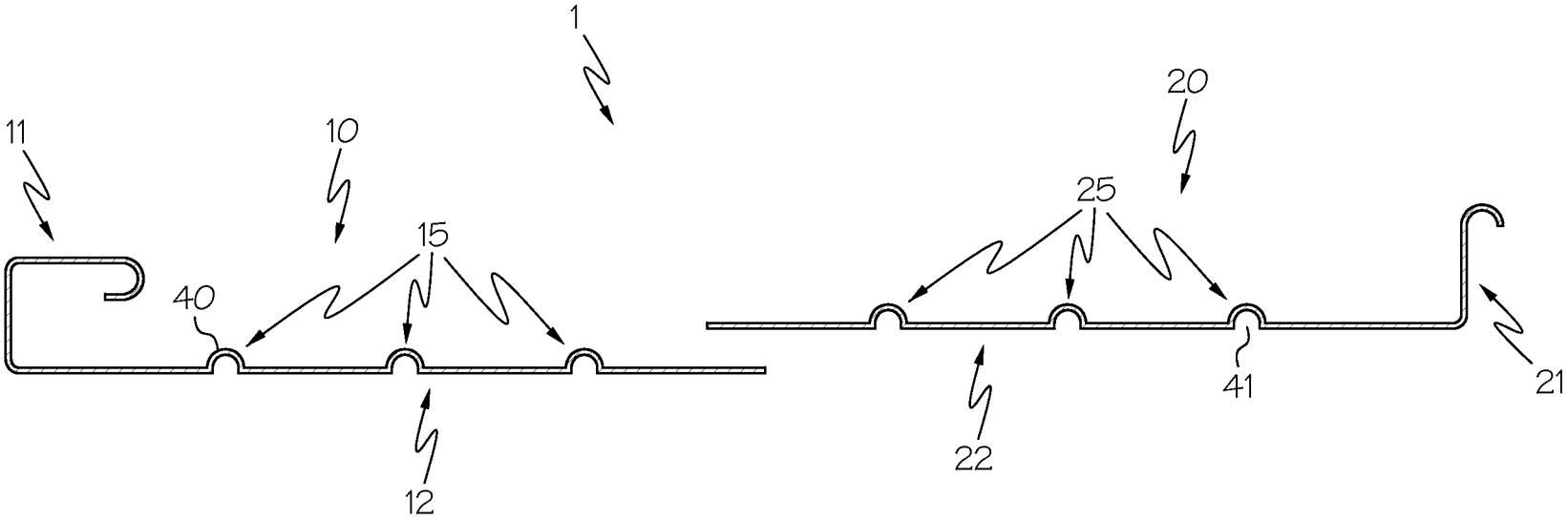
FIG. 3 depicts a side view section of an embodiment of an adjustable gutter hanger without the coupler.

The first and second face interlocking mechanisms (15, 25) prevent the gutter attachment piece (10) and the building attachment piece (20) from sliding when the coupler (30) has secured them together. The first and second face interlocking mechanisms (15, 25) are part of the gutter attachment piece (10) and the building attachment piece (20), respectively. There is at least one raised portion (40) and at least one lowered portion (41) among the two face interlocking mechanisms (15, 25). The raised and the lowered portions (40, 41) on the pieces fit together. In some embodiments, as shown in FIGS. 1-3, there are many raised and lowered portions on the first and second face interlocking mechanisms (15, 25) that form sawteeth. At least some of the raised portions on the first interlocking mechanism (15) fit into some of the lowered portions on the second interlocking mechanism (25), and vice versa. In some embodiments, the raised and lowered portions allow the gutter attachment piece (10) and the building attachment piece (20) to slide in a transverse direction to each other. This may make it easier to install. In some embodiments, the raised portion is also the coupler; the lowered portion is one or more openings that receive the coupler. There may be more than one coupler to fit into more than one opening. The coupler, such as the one shown in FIGS. 5 and 6, may clip onto one or more openings. In some embodiments, the opening is a well and not a hole, and the coupler engages the edges or sides of the well.

In some embodiments, as shown in FIG. 3, there are few raised and lowered portions (40, 41) in the first and second face interlocking mechanisms (15, 25). In this embodiment, the first interlocking mechanism (15) comprises ridges for the raised portion (40), and the second interlocking mechanism (25) comprises valleys for the lowered portions (41). For example, the embodiment shown in FIG. 3, only has three ridges and three valleys, but there may be any number of multiple ridges and valleys, such as at least 1, 2, 3, 4, 5, 6, 7, 8, 9, or 10 ridges or valleys. When there are fewer ridges and valleys, the first and second face interlocking mechanisms (15, 25) may fit together in a limited number of ways, where each way that fits together will adjust the length of the adjustable gutter hanger (1). This is useful because the adjustable gutter hanger (1) can be designed to specifically fit several gutters of different sizes, such as, but not limited to, 4.5 inch, 5 inch, and 6 inch gutters.

The first and second face interlocking mechanisms (15, 25) are not required to have the same number of ridges as valleys; there may be more of one than the other to allow for greater adjustability, such as the embodiment shown in FIGS. 5 and 6, which have four raised portions and six lowered portions. In some embodiments, the ridges of the first and second face interlocking mechanisms (15, 25) are parallel to the length of the gutter when the adjustable gutter hanger (1) is mounted in the gutter, i.e. perpendicular to the length of the gutter hanger. In some embodiments, the ridges of the first and second face interlocking mechanisms (15, 25) are not parallel to the length of the gutter when the adjustable gutter hanger (1) is mounted in the gutter. In some embodiments, the ridges of the first and second face interlocking mechanisms (15, 25) are not perpendicular to the length of the gutter when the adjustable gutter hanger (1) is mounted in the gutter. In some embodiments, the first and second face interlocking mechanisms (15, 25) are sawteeth as shown in FIGS. 1 and 2, which have many ridges and valleys. In some embodiments, the sawteeth are a "one-way sawtooth structure" which means a structure such that the two pieces can slide easily with respect to each other in only one direction and are difficult to slide in the reverse direction. This one-way sawtooth structure is created when the slope of one side of the ridge is steeper than the other side of the ridge. The valleys have slopes that match their interlocking ridges.

In some embodiments, the raised and lowered portions of the first and second face interlocking mechanisms (15, 25) are not ridges and valleys. They may be for example, pegs and holes; or wavy or curved ridges and valleys; or raised and lowered circles or other shapes. FIGS. 5 and 6 show an interlocking mechanism (15, 25) which comprises pegs and holes. The pegs are designed to incorporate a coupler (30) which holds the gutter attachment piece (10) and the building attachment piece (20) together by clipping onto the solid portion between the holes on the gutter attachment piece (10).

In some embodiments, at least one of the first or second openings (14, 24) for receiving the coupler (30) on the gutter attachment piece (10) or the building attachment piece (20) is a slot. A slot allows the gutter attachment piece (10) and building attachment piece (20) to slide relative to each before the coupler (30) is tightened but inserted in the first and second openings (14, 24). The slot may be in the gutter attachment piece (10), the building attachment piece (20) or both. In some embodiments, there are multiple openings for receiving the coupler (30) on the gutter attachment piece (10), the building attachment piece (20), or both.

The coupler (30) holds the gutter attachment piece (10) and the building attachment piece (20) together. Examples of the coupler (30) include, but are not limited to, a screw and wing-nut, a screw and nut, a rivet, and raised portions on the gutter attachment piece (10), the building attachment piece (20), or both.

In some embodiments the mounting section (21) comprises an opening adapted to receive a fastener (26) so the fastener (26) will pass through the back of the gutter. A fastener, such as, but not limited to, a nail or screw, will pass through the opening in the mounting section and pierce the rear edge of the gutter to secure the gutter to the building it is being mounted on. In some embodiments, the mounting section (21) comprises a tab (27) that fits behind the back of the gutter as shown in FIGS. 5 and 6. In some embodiments, the mounting section (21) is a flat piece that extends above, below, or both above and below the second flat portion (22).

The gutter attachment piece (10) is designed to contact and hold the front of the gutter. The gutter attachment portion (11) is adapted to attach to the front of a gutter, such as by fitting under the inside lip of the gutter.

Figure 7:
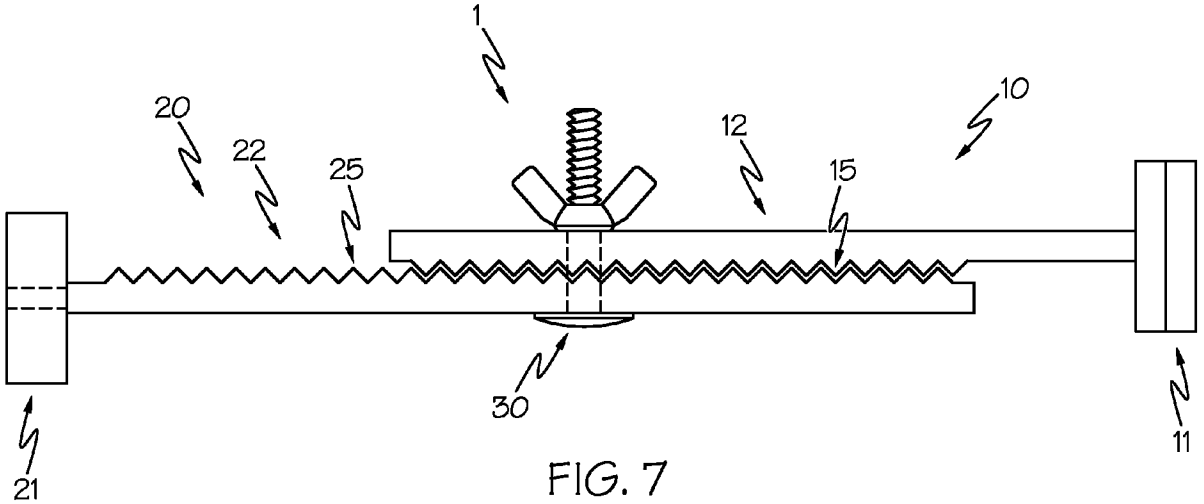
FIG. 7 depicts a side view of an embodiment of an adjustable gutter hanger.

In some embodiments, as shown in FIG. 7, which shows a top view of the adjustable gutter hanger (1), the gutter attachment piece (10) and the building attachment piece (20) are configured so that the interlocking mechanisms (15, 25) are on the side of the pieces. In addition, the coupler enters through the sides of the pieces.

Figure 8:
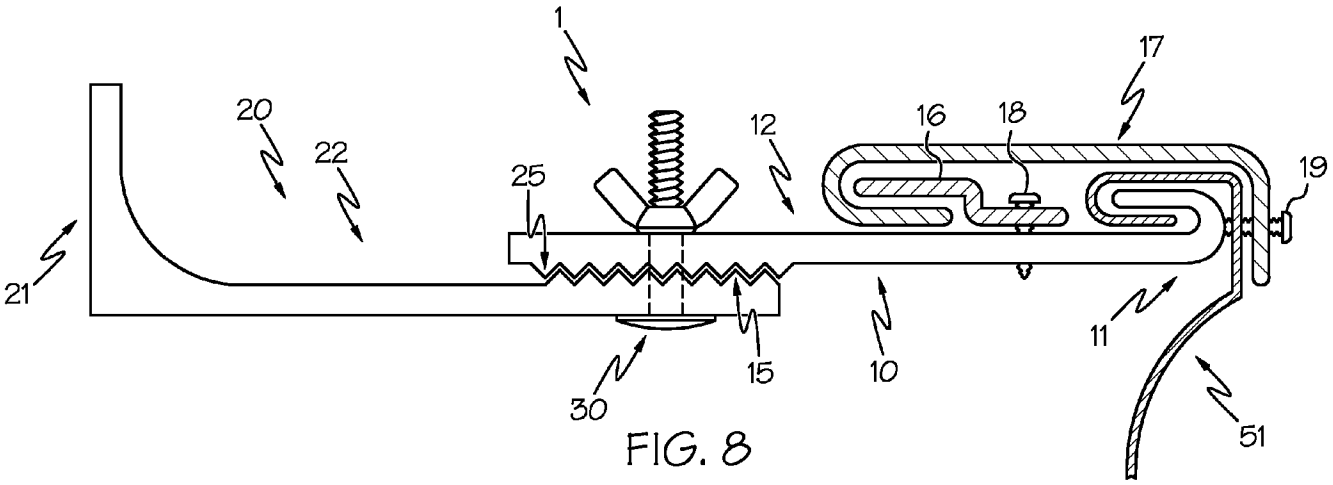
FIG. 8 depicts a side view of an embodiment of an adjustable gutter hanger.

In some embodiments, the adjustable gutter hanger (1), is designed to withstand heavy snow. As shown in FIG. 8, the attachment by the gutter attachment piece (10) to the front lip of the gutter (51) is reinforced. A gutter attachment clip (16) is fastened to the gutter attachment piece (10) with a clip fastener (18). Examples of the clip fastener (18) include, but are not limited to, a screw and wing-nut, a screw and nut, a rivet, and a zip screw. The lip cap (17) is clipped to the gutter attachment clip (16) and attached to the front lip of the gutter (51) by a lip fastener (19). Examples of the lip fastener (19) include, but are not limited to, a screw and wing-nut, a screw and nut, a rivet, and a zip screw.

Figure 9:
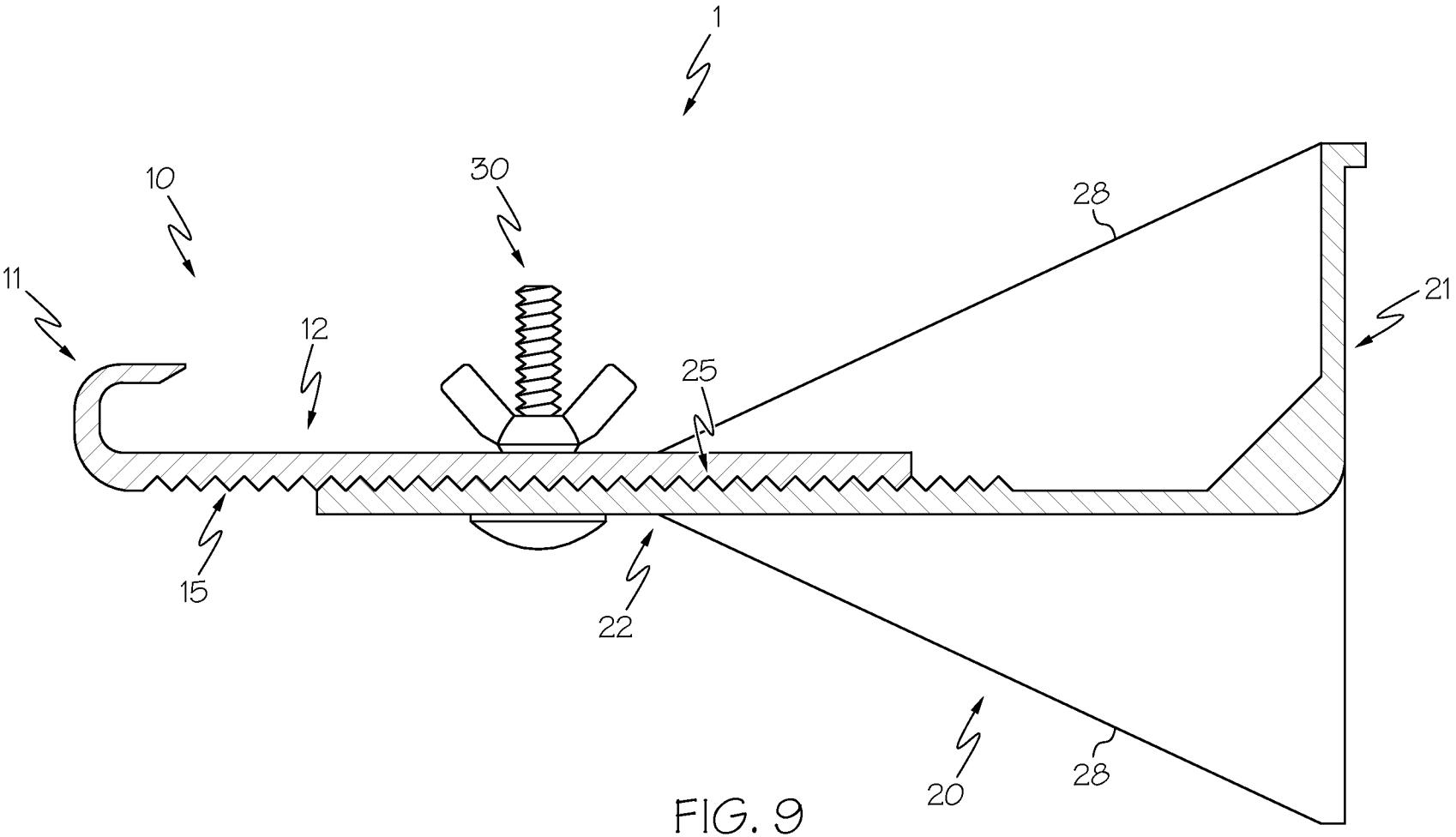
FIG. 9 depicts a side view of an embodiment of an adjustable gutter hanger.
Figure 10:
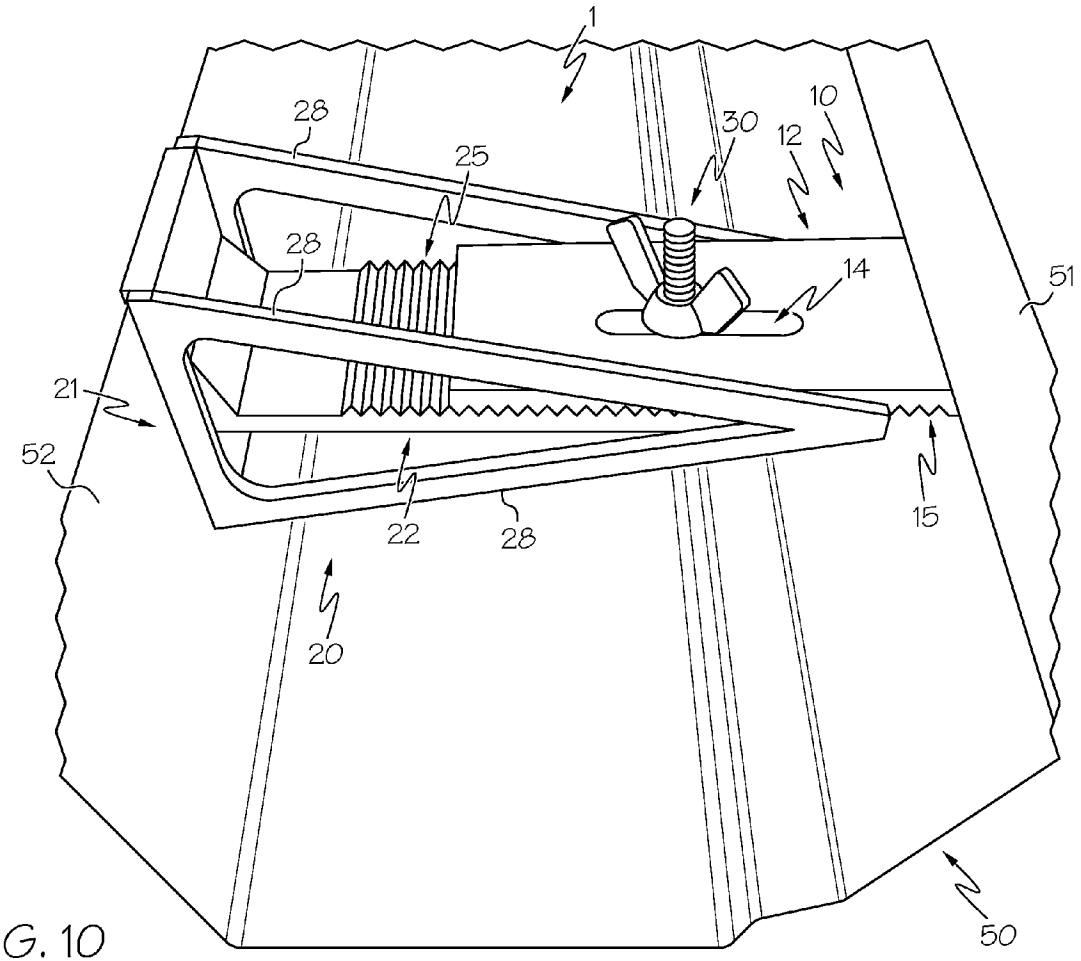
FIG. 10 depicts a perspective view of an embodiment of an adjustable gutter hanger installed in a gutter.

In some embodiments, the adjustable gutter hanger (1) additionally comprises one or more side supports (28). As shown in FIGS. 9 and 10, the side supports (28) extend from the mounting section (21) to the second flat portion (22) and provide additional strength and support to the adjustable gutter hanger (1). In some embodiments the side supports (28) are a solid wall as shown in FIG. 9. In some embodiments, the side supports (28) are a bar as shown in FIG. 10. The side supports (28) may extend to the mounting section (21) above, below, or both above and below the second flat portion (22). The side supports (28) may extend the length of the second flat portion (22) or only to a portion of the second flat portion (22).

A method for supporting a gutter on a building comprises the steps of: A) attaching a gutter attachment piece (10) to the front of the gutter, B) contacting a building attachment piece (20) to the rear of the gutter, C) interlocking the first and second face interlocking mechanisms (15, 25), D) securing the gutter attachment piece (10) and building attachment piece (20) together with the coupler (30), and E) attaching the building attachment piece (20) to the building. These steps may be carried out in most any order.

In some embodiments, the method additionally comprises the step of inserting the coupler (30) through the first and second openings (14, 24).

While the present disclosure has illustrated by description several embodiments and while the illustrative embodiments have been described in detail, it is not the intention of the applicant to restrict or in any way limit the scope of the appended claims to such detail. Additional advantages and modifications may readily appear to those skilled in the art.

What is claimed is:

1. An adjustable gutter hanger comprising:

a gutter attachment piece, a building attachment piece, and a coupler;

wherein the gutter attachment piece comprises a gutter attachment portion adapted to contact the front of a gutter and a first flat portion extending from the gutter attachment portion; wherein the first flat portion has a first face interlocking mechanism;

wherein the building attachment piece comprises a mounting section adapted to fixedly attach the rear of the gutter to a building and a second flat portion extending from the mounting section; wherein the second flat portion has a second face interlocking mechanism; wherein mounting section, the second flat portion, and the second face interlocking mechanism of the building attachment piece comprise a single piece of material;

wherein at least one of the first flat portion or the second flat portion comprises at least one opening for receiving the coupler;

wherein the coupler is adapted to pass through the at least one opening to secure the first and second flat portions together; and wherein the first and second face interlocking mechanisms each comprise at least one interlocking portion that engage each other to prevent slipping;

wherein the first and second face interlocking mechanisms comprise raised or lowered portions, wherein among the first and second face interlocking mechanisms there is at least one raised and at least one lowered portion;

wherein the raised portion of the face interlocking mechanism comprises ridges and the lowered portion of the face interlocking mechanism comprises valleys.

2. The adjustable gutter hanger of claim 1, wherein the ridges are perpendicular to the length of the adjustable gutter hanger.

3. The adjustable gutter hanger of claim 1, wherein there are from one to eight ridges and valleys that are evenly spaced apart.

4. The adjustable gutter hanger of claim 3, wherein when the ridges and valley are fit together, the adjustable gutter hanger will fit at least one of a 4.5 inch, 5 inch, and 6 inch gutter.

5. The adjustable gutter hanger of claim 1, wherein the two face interlocking mechanisms are sawteeth.

6. The adjustable gutter hanger of claim 1, wherein the first flat portion has a first opening for receiving the coupler and the second flat portion has a second opening for receiving the coupler.

7. The adjustable gutter hanger of claim 6, wherein at least one of the first and second openings is a slot.

8. The adjustable gutter hanger of claim 6, wherein the coupler is a screw and wing-nut.

9. The adjustable gutter hanger of claim 1, wherein the at least one of the raised portions comprises the coupler and at least one of the lowered portions comprises an opening for receiving the coupler.

10. The adjustable gutter hanger of claim 1, wherein the mounting section comprises a third opening adapted to receive a fastener so the fastener will pass through the back of the gutter.

* * * * *